United States Patent [19]

Ross, Jr.

[11] Patent Number: 4,899,766

[45] Date of Patent: Feb. 13, 1990

[54] SECONDARY SMOKE CATCHER

[76] Inventor: John R. Ross, Jr., 13020 Longboat Way, Del Mar, Calif. 92014

[21] Appl. No.: 272,919

[22] Filed: Nov. 18, 1988

[51] Int. Cl.[4] ..... A24D 1/00; A24F 1/00; A24F 5/00

[52] U.S. Cl. ..... 131/175; 131/211; 131/212.1; 131/213; 131/215.2; 131/215.3

[58] Field of Search ..... 131/175, 211, 212.1, 131/213, 215.1, 215.2, 215.3

[56] References Cited

U.S. PATENT DOCUMENTS

| | | | |
|---|---|---|---|
| 3,827,444 | 8/1974 | Khan | 131/175 |
| 4,369,798 | 1/1983 | Jackson | 131/212.1 |
| 4,790,332 | 12/1988 | Wallace | 131/215.1 |

*Primary Examiner*—V. Millin
*Assistant Examiner*—Jennifer L. Doyle
*Attorney, Agent, or Firm*—John R. Ross, Jr.

[57] ABSTRACT

A smoke catcher device which catches essentially 100% of secondary smoke products such as cigarettes, cigars and pipes. The device comprises a housing having an interior space. The smoke product is installed in the housing such that the burning end of the product is in the interior space and the lip end is on the ouside of the housing. The housing also comprises a smoke intake opening and an exhaust port. The secondary smoke is exhausted through an appropriate filter system or to a smoke dump place. In use a smoker sucks smoke through the lip end of the smoke product and exhales the smoke into the smoke intake opening.

11 Claims, 5 Drawing Sheets

SECONDARY SMOKE CATCHER

This invention relates to devices for catching secondary cigarette cigar and pipe smoke.

BACKGROUND OF THE INVENTION

One of the most serious health hazards in the world today is cigarette, cigar and pipe smoke. The risk extends not only to the smoker but also to people who do not smoke but breath the smoke produced by the smoker. States and communities are beginning to pass laws to protect people from this secondary smoke, but these laws have been criticized for infringing on the rights of the smokers.

What is needed is a device which will allow people stupid enough to smoke to do it, while protecting their neighbors from the effects of secondary smoke.

SUMMARY OF THE INVENTION

The present invention provides a smoke catcher device which catches essentially 100% of secondary smoke from smoke products such as cigarettes, cigars and pipes. The device comprises a housing having an interior space. The smoke product is installed in the housing such that the burning end of the product is in the interior space and the lip end is on the outside of the housing. The housing also comprises a smoke intake opening and an exhaust port. An exhausting means is provided to exhaust the secondary smoke through an appropriate filter system or to a smoke dump place. In use a smoker sucks smoke through the lip end of the smoke product and exhales the smoke into the smoke intake opening. The smoke directly from the burning smoke product and the exhaled smoke are both exhausted through the exhaust port by the exhausting means. A preferred embodiment contains a trigger operated value which closes off the smoke intake opening except when smoke is being exhaled into it. In another preferred embodiment the device is fabricated in the shape of a hand gun.

DETAILED DESCRIPTION OF PREFERRED EMBODIMENTS

The present invention can be described by reference to the figures.

Figure 1:
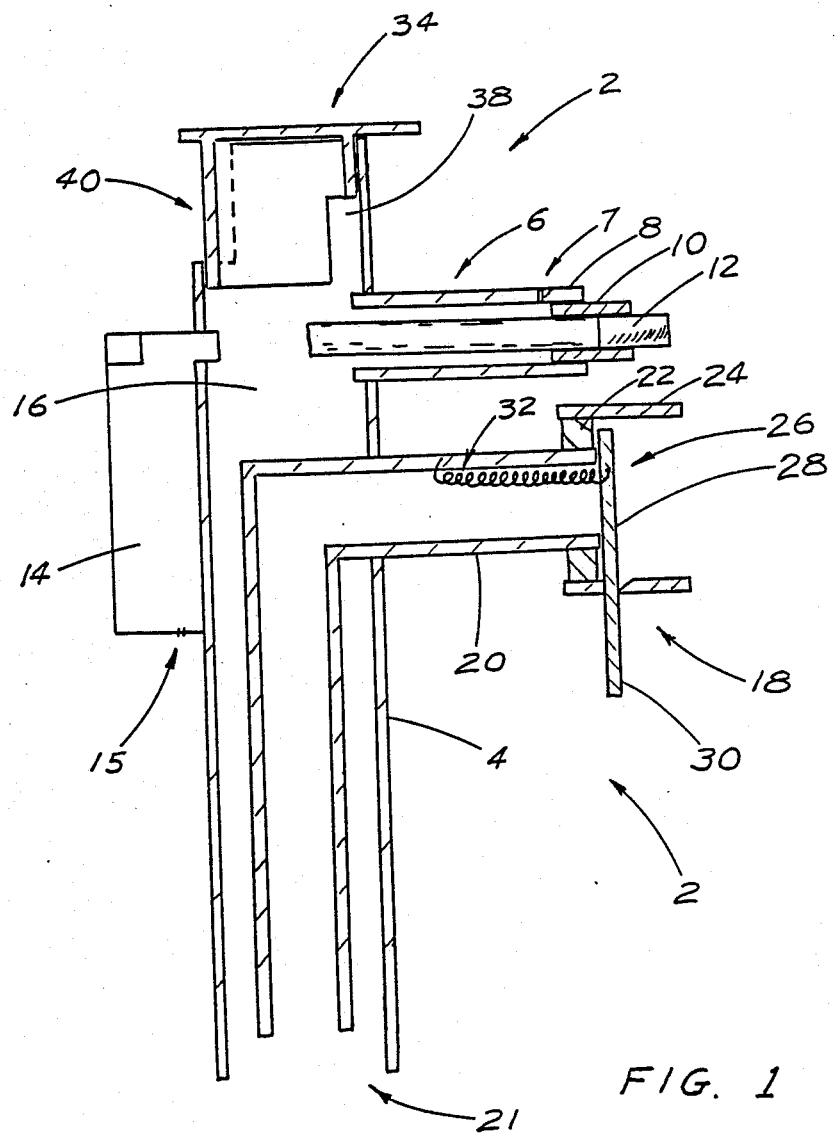
FIG. 1 is a cutaway drawing of a preferred embodiment of the present invention.

Referring to FIG. 1, a housing 2 is comprised primarily of a 3 cm diameter plexiglass tube 4. A cigarette holder tube 6 comprised of a 1.7 cm diameter tube 8 and 1.2 cm diameter smaller tube 10 is mounted in the upper portion of housing 4. The inside diameter of smaller tube 10 is approximately equal to the outside diameter of a standard size cigarette so that cigarette 12 fits snuggly through smaller tube 10. The cigarette is installed so that approximately 1 cm of the butt sticks out as shown in FIG. 1, and the burn end of cigarette 12 extends to the center line of tube 4. A 1 mm diameter air hole 7 is drilled in tube 8 just beyond the end of smaller tube 10 as shown in FIG. 1. A refillable piezoelectric pipe lighter 14 is attached to housing 2. The flame exit port of the lighter extends through the side of housing 2 into the interior space 16 of housing 2. A smoke intake opening 18 is comprised of 1.5 cm plexiglass tube 20 which extends through the side of housing 2, bends and extends down the center line of housing 2 toward an exit port 21 of housing 2. Intake opening 18 also comprises annular spacer 22 and 3.6 cm diameter tube 24. Opening 81 also comprises trigger valve 26 comprised of circular valve flap 28, trigger 30 and spring 32. Lighter 14 is refillable through port 15.

Cap 34 is comprised of plexiglass tube 36 selected to fit snuggly in the top of tube 4. Tube 36 is notched over ¼ th of its circumference as shown at 38. Tube 4 is also notched over ¼ th of its circumference as shown at 40. With the cap as shown in FIG. 1 the top of housing 2 is "closed". By rotating cap 34 180 degrees, the notches in tube 40 and tube 36 line up to provide a 2½ square cm opening at the top of housing 2.

Figure 2:
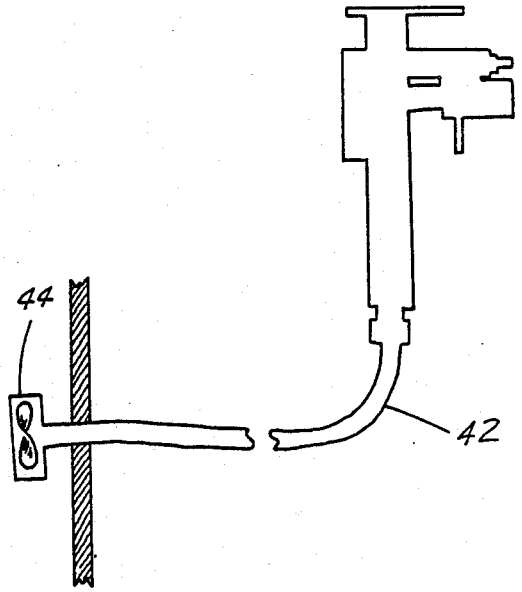
FIG. 2 is a sketch showing a particular utilization of the embodiment shown in FIG. 1.
Figure 3:
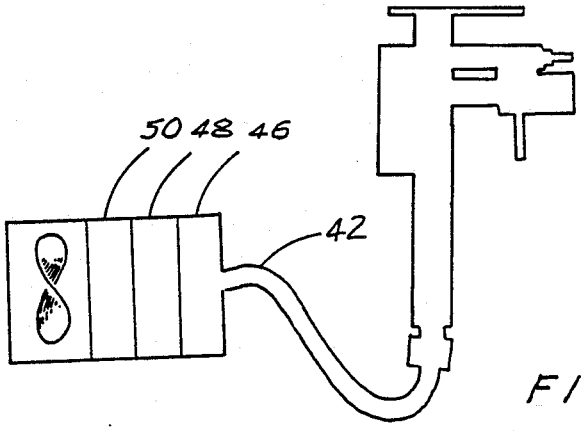
FIG. 3 is a sketch showing another particular utilization of the embodiment shown in FIG. 1.

Smoke from cigarette 12 may either be exhausted outdoors as shown in FIG. 2 by fan 44 through flexible tube 42 or drawn through filters 46, 48 and 50 as shown in FIG. 3.

Figure 4:
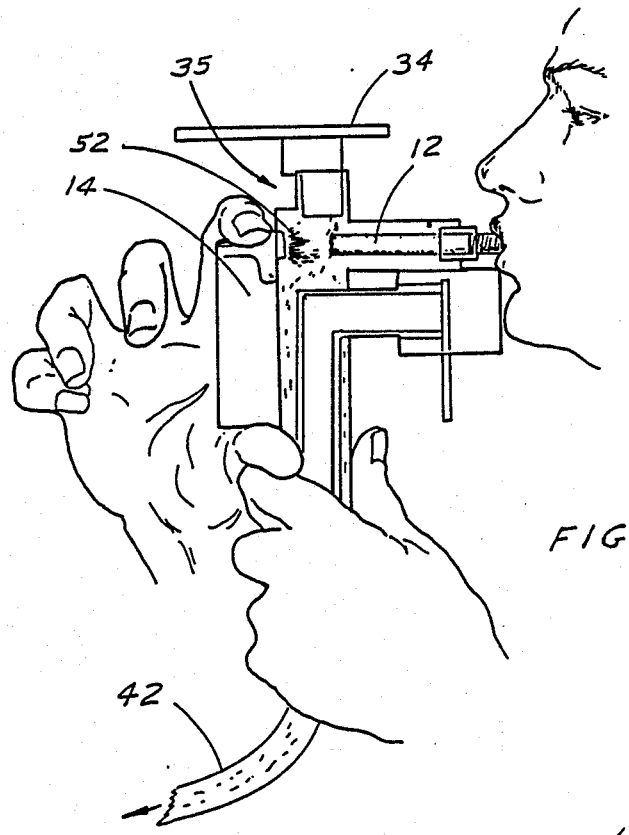
FIGS. 4, 5 and 6 are drawings showing the FIG. 1 embodiment in use
Figure 5:
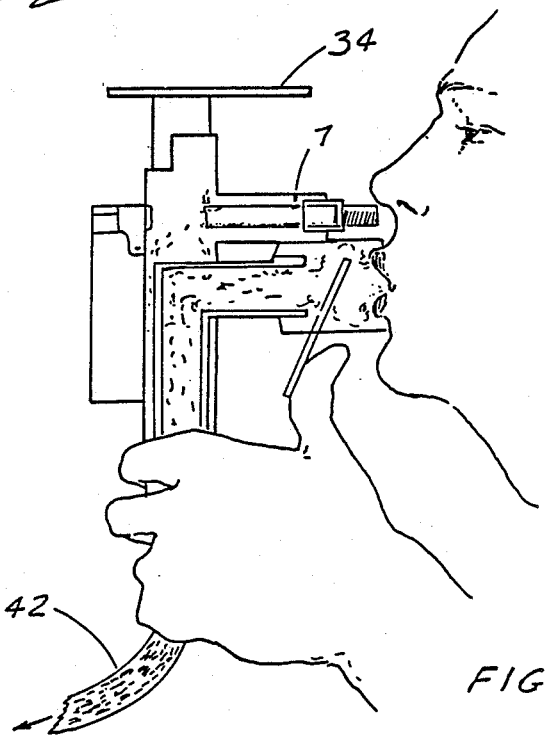
Figure 6:
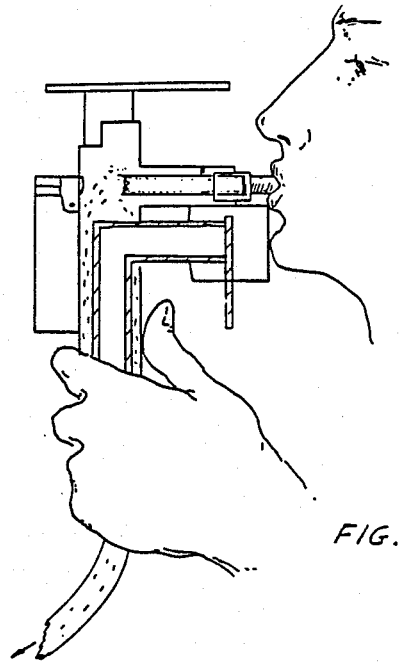

The operation of this preferred embodiment is shown in FIGS. 4, 5 and 6. As shown in FIG. 4 cap 34 is placed in its open position as indicated at 35. Lighter 14 is triggered generating flame 52. The smoker sucks on cigarette 12 breathing cancer and heart disease causing smoke into his tender lungs. Cap 34 is then rotated to its closed position as shown in FIG. 5 Trigger 30 is then pulled opening intake opening 18. The smoker then exhales the vile smoke into intake opening 18. Both the smoke directly from cigarette 12 and from the lungs of the smoker are sucked out through hose 52. Smoker continues to such smoke from cigarette 12 as shown in FIG. 6 and exhale the smoke as shown in FIG. 5 until cigarette 12 is burned down to near its butt. Air hole 7 provides just the right amount of fresh air to keep cigarette 12 lighted. Cap 34 can be removed to permit ashes to be dumped out.

Figure 7:
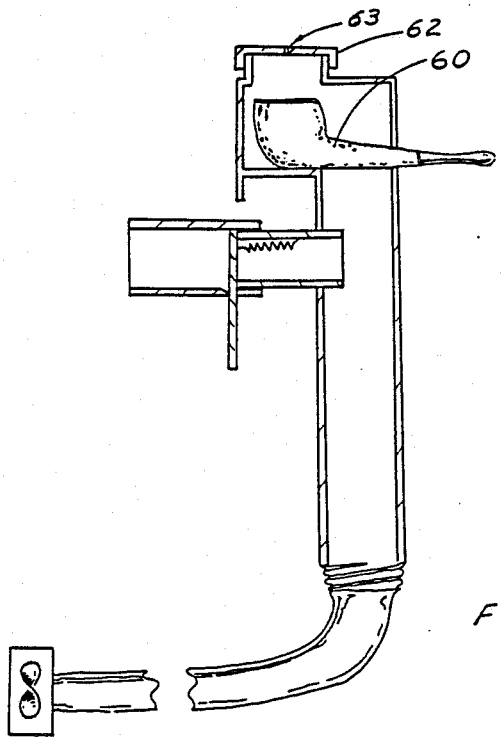
FIG. 7 is a cutaway drawing of an embodiment of the present invention designed for friends of pipe smokers.

A second preferred embodiment of the present invention is shown in FIG. 7. This embodiment is basically the same as the one shown in FIGS. 1–6 but a pipe 60 replaced cigarette 12. Also, this embodiment contains a removable cap 62 so that the pipe can be refilled with tobacco. The pipe is lighted with an external lighter not shown. After the pipe is lighted the cap is replaced and the operation is similar to that shown in FIGS. 5 and 6. Cap 62 has a 1 mm diameter hole in its top as shown at 63 to provide fresh air for the burning tobacco.

An embodiment suitable for use with cigars can be fabricated and used as shown in FIGS. 1–6 except the dimensions would be appropriately different. Suction sources can be any of numerous means for creating a vacuum at the exhaust port of housing 2. In my prototype used a 4 inch diameter cooling fan which has a flow rate of about 1 cubic foot per minute. The fan created a slight vacuum equivalent to about 1 cm of water at no flow.

In my experimentation with filters as shown in FIG. 3, I found I had best results using a combination of commercially available respirator filters: 46, 48 and 50. I used a combination of filters sold by North Safety Equipment of Cranston, RI. These were chemical cartridge (North Part No. N7500-3) for organic vapors, chlorine, hydrogen chloride, sulfur dioxide and formaldehyde; cartridge (North Part No. N75004) for ammonia and methyamine and dust cartridge (North Part No. N7500-8). Persons skilled in the art will recognise that there are many other filter combinations which could be substituted. The idea is to capture as much of the pollution from the secondary smoke as is feasible considering cost and other factors. According to a 1986 Surgeon General's Report, cigarette smoke contains the following vapor phase constituents:

carbon monoxide, carbon dioxide, carboyl sulfide, benzene, toluene formaldehyde, acrolein, acetone, pyridine 3-methylpyridine, 3-vinylpyridine, hydrogen cyanide, hydrazine ammonia, methylamine dimethylamine, nitrogen oxide, N-nitrosodimethylamine, N-nitrosopyrrolidine, formic acid acetic acid;

and the following particle phase constituents:

particle matter, nicotine, anatabine phenol catechol hydroquinone aniline, 2-toluidine, 2-naphthylamine, 4-aminobiphenyl, benz[a]anthracene, benzol[a]pyrene, cholesterol, r-butyrolactone, quinoline harman N-nitroson or nicotine, NNK, N-nitrosodienthanolamine cadmium nickel zink plonium-210, benzioc acid, glycolic, succinic acid.

Figure 8:
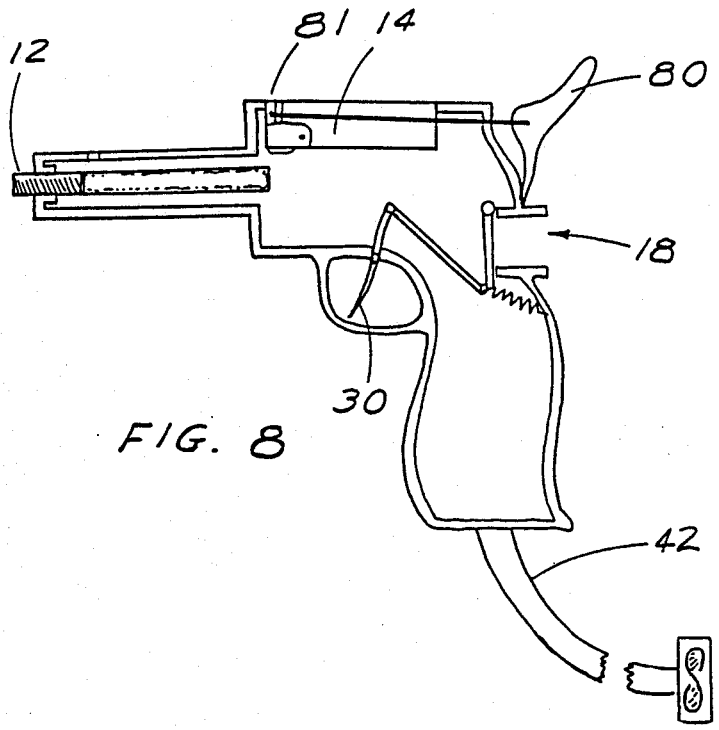
FIG. 8 is a cutaway drawing of an embodiment of the present invention in the shape of a hand gun.

As indicated above, I call my invention the smoking gun. The idea is that smoking cigarettes is like playing Russian Roulette with yourself. But why irritate your friends in the process of killing yourself? Perhaps sticking the barrel of a gun in your mouth will get this point across. To improve the analogy the shape of my smoke catcher is preferably that of a hand gun. I have indicated this in FIG. 8. Note the cigarette 12, lighter 14, trigger 30, smoke intake opening 18 and exhaust tube 42. Cigarette 12 is lighted by cocking hammer 80. Cocking hammer 80 also opens air vent 81.

Figure 9:
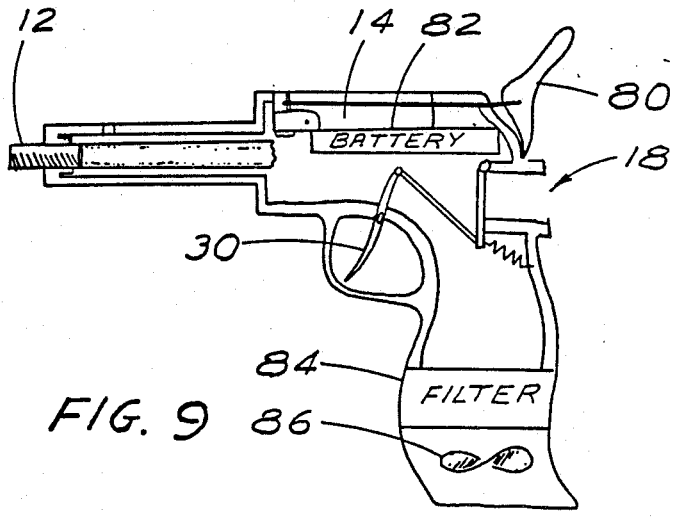
FIG. 9 is a cutaway drawing of a portable version of the FIG. 8 embodiment.

FIG. 9 shows a similar "smoking gun", but here the gun is made portable by including in the body of the "gun" compact filters 84, a rechargable battery 82 which operates small fan 86 through electrical connections not shown. FIG. 9 shows the cigarette 12, lighter 14 trigger 30, smoke intake opening 18. The filters 84 are preferably made from the same materials as the North filters discussed above or equivalent. However, the filters are made more compact so as to fit in the handle of the "gun".

While the invention has been described in detail herein in accord with certain preferred embodiments thereof, many modifications and changes therein may be effected by those skilled in the art. Accordingly it is intended by the appended claims to cover all such modifications and changes as fall within the true spirit and scope of the invention.

I claim:

1. A smoke catcher device for catching the secondary smoke from smoke products, such as cigarettes, cigars and pipes, and from the mouth of a smoker of said smoke product comprising:

a housing having an enclosed interior space and comprising:

a means for installing one of said smoke products in said housing such that the burning end of said smoke product is inside said interior space and the lip end of said smoke product extends outside said interior space, a smoke intake opening for permitting said smoker to exhale into said interior space smoke sucked by said smoker from said one of said smoke products, and an exhaust port, and an exhaust means for exhausting the contents of said interior space to a smoke dump place or through one or more filters.

2. A device according to claim 1 wherein the contents of said interior are exhausted to a smoke dump place.

3. A device according to claim 1 wherein the contents of said interior space are exhausted through a filter.

4. A device according to claim 3 wherein said filter is designed to trap the constituents of cigarette smoke.

5. A device according to claim 1 and further comprising a valve means for closing said smoke intake opening except when smoke is being exhaled into said interior space.

6. A device according to claim 5 and further comprising a trigger for operating said valve means.

7. A device according to claim 1 wherein said exhaust means comprises a flexible tube and a fan.

8. A device according to claim 1 further comprising a lighter means for lighting said smoke product inside said interior space.

9. A device according to claim 1 wherein said device is in the general shape of a hand gun.

10. A device according to claim 3 and further comprising a rechargible battery for operating said exhaust means.

11. A device according to claim 10 wherein said device is in the general shape of a hand gun.

* * * * *